US011515115B2

(12) United States Patent
Jamdade et al.

(10) Patent No.: US 11,515,115 B2
(45) Date of Patent: Nov. 29, 2022

(54) SHUNT TRIP ASSEMBLY

(71) Applicant: Eaton Intelligent Power Limited, Dublin (IE)

(72) Inventors: Akshay B. Jamdade, Pune (IN); Karthik Satyanarayanan, Pune (IN); Srushti Kawale, Pune (IN); Nilesh Sawai, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 449 days.

(21) Appl. No.: 16/698,002

(22) Filed: Nov. 27, 2019

(65) Prior Publication Data

US 2021/0159037 A1 May 27, 2021

(51) Int. Cl.

| | |
|---|---|
| ***H01H 50/64*** | (2006.01) |
| ***H01H 50/02*** | (2006.01) |
| ***H01H 47/22*** | (2006.01) |
| ***H01H 50/18*** | (2006.01) |
| *H01H 50/54* | (2006.01) |

(52) U.S. Cl.

CPC ..... *H01H 50/643* (2013.01); *H01H 47/22* (2013.01); *H01H 50/023* (2013.01); *H01H 50/18* (2013.01); *H01H 50/54* (2013.01); *H01H 2235/01* (2013.01)

(58) Field of Classification Search

CPC ..... H01H 50/643
USPC ..... 335/21, 71, 68
See application file for complete search history.

(56) References Cited

U.S. PATENT DOCUMENTS

| | | | | |
|---|---|---|---|---|
| 3,332,043 | A * | 7/1967 | Camp | H01H 3/42 335/73 |
| 4,209,761 | A * | 6/1980 | Klein | H01H 71/462 335/17 |
| 5,264,673 | A * | 11/1993 | Powell | H01H 71/46 200/318 |
| 5,343,179 | A * | 8/1994 | Pipich | H01H 71/2463 335/172 |
| 5,581,219 | A * | 12/1996 | Nozawa | H01H 71/0228 335/8 |
| 5,910,758 | A | 6/1999 | Maloney et al. | |
| 6,040,746 | A | 3/2000 | Maloney et al. | |
| 6,218,921 | B1 | 4/2001 | Eberts et al. | |
| 6,400,242 | B1 | 6/2002 | Fasano et al. | |
| 6,414,601 | B1 | 7/2002 | Massedonio | |
| 6,584,997 | B1 | 7/2003 | Blichmann et al. | |

(Continued)

FOREIGN PATENT DOCUMENTS

CA 2121850 12/1994

OTHER PUBLICATIONS

USPTO, "Notice of Allowance and Fee(s) Due" for corresponding U.S. Appl. No. 17/136,322, dated Dec. 8, 2021, 13 pp.

*Primary Examiner* — Alexander Talpalatski
(74) *Attorney, Agent, or Firm* — Eckert Seamans Cherin & Mellott, LLC

(57) ABSTRACT

A shunt trip assembly is structured to be operatively coupled to a number of circuit breakers. The shunt trip assembly includes a housing assembly and an actuating assembly. The actuating assembly includes a limited number of components. In another embodiment, the shunt trip assembly housing assembly is a substantially sealed housing assembly. In another embodiment, the shunt trip assembly housing assembly includes a single mounting panel.

15 Claims, 9 Drawing Sheets

(56) References Cited

U.S. PATENT DOCUMENTS

| | | | | |
|---|---|---|---|---|
| 7,532,095 | B2 * | 5/2009 | Schmidt | H01H 71/70 335/11 |
| 7,623,010 | B2 * | 11/2009 | Liu | H01H 50/32 335/121 |
| 8,368,489 | B2 * | 2/2013 | Sohn | H01H 83/20 335/78 |
| 9,184,571 | B2 | 11/2015 | Lias et al. | |
| 9,368,959 | B2 | 6/2016 | Wright, Jr. et al. | |
| 10,107,260 | B2 | 10/2018 | Ritter et al. | |
| 10,215,146 | B2 | 2/2019 | Schnellinger et al. | |
| 11,232,923 | B2 * | 1/2022 | Fasano | H01H 50/641 |
| 2007/0188335 | A1 | 8/2007 | Shea | |
| 2008/0246569 | A1 | 10/2008 | Bogdon et al. | |
| 2015/0213989 | A1 | 7/2015 | Kasprzycki et al. | |
| 2017/0331275 | A1 | 11/2017 | White | |
| 2019/0081458 | A1 | 3/2019 | Lapushner et al. | |
| 2019/0131090 | A1 | 5/2019 | Dixit et al. | |

* cited by examiner

SHUNT TRIP ASSEMBLY

BACKGROUND OF THE INVENTION

Field of the Invention

The disclosed and claimed concept relates to a miniature circuit breaker installation and, more specifically, to a shunt trip assembly for a circuit breaker installation.

Background Information

Electrical switching apparatus such as circuit interrupters and, in particular, circuit breakers of the molded case variety, are well known in the art. Circuit breakers are used to protect electrical circuitry from damage due to an over-current condition, such as an overload condition or a relatively high level short circuit or fault condition. Circuit breakers typically include an operating mechanism and one pair of separable contacts per current phase. The operating mechanism is operatively coupled to each pair of separable contacts. That is, the separable contacts, typically, include a stationary or fixed contact and a movable contact. The operating mechanism is operatively coupled to each movable contact. The movable contacts are structured to move between a first position, wherein the movable contact is spaced from the fixed contact and is not in electrical communication therewith, and, a second positon, wherein the movable contact is directly coupled to the fixed contact and is in electrical communication therewith. The operating mechanism is structured to rapidly move between at least two configurations; a first configuration wherein the movable contacts are in their first position, and a second configuration, wherein the movable contacts are in their second position. That is, the configuration of the operating mechanism corresponds to the position of the movable contacts. Typically, the operating mechanism is biased toward the first position.

The operating mechanism/separable contacts may be operated either manually by way of a handle disposed on the outside of the case, automatically in response to an overcurrent condition, or remotely via a shunt trip assembly. That is, for manual operation, a handle is operatively coupled to the operating mechanism and is structured to move the operating mechanism between at least the first and second configurations.

For automatic operation in response to an overcurrent condition, the circuit breaker includes a trip unit assembly, which senses overcurrent conditions, and a trip actuator assembly. The trip actuator assembly is actuated by the trip unit assembly in response to an overcurrent condition and moves the operating mechanism to a trip state which is, typically, the first configuration noted above. That is, in the trip state the separable contacts move to their first position. Trip unit assemblies, in some embodiments, include mechanical devices that react magnetically or thermally to overcurrent conditions. The mechanical devices are mechanically operatively coupled to the operating mechanism. For example, one type of thermally responsive mechanical device includes a bimetal strip which is an elongated strip including two layers of different metals. The operating mechanism/trip unit assembly includes springs that bias the operating mechanism to the first configuration. A portion of the bimetal strip is disposed in the path of an element of the operating mechanism and acts as a latch. The current passes through the bimetal strip. When an overcurrent condition occurs, the layers of the bimetal strip heat up.

Because the different metals have different rates of thermal expansion, the bimetal strip bends. As the bimetal strip bends, the bimetal strip moves out of the path of the operating mechanism and allows the operating mechanism, and therefore the movable contacts, to move to the first configuration. That is, during an over current condition, the bimetal strip unlatches the operating mechanism. The bimetal strip is calibrated to bend at a specific rate so that the operating mechanism is released at a preselected overcurrent condition.

Further, the shunt trip assembly includes a limited functionality breaker mechanism includes elements similar to the circuit breaker described above including an operating mechanism and a trip device having a latch. As with the circuit breaker described above, the trip device latch blocks (or otherwise stops) the motion of the operating mechanism. Generally, the actuator, e.g., the solenoid, is operatively coupled to the operating mechanism, and/or the latch that blocks the motion of the operating mechanism. That is, a solenoid includes a movable element identified as a "plunger." When the shunt trip assembly solenoid is energized thereby allowing/causing the operating mechanism to move to the first configuration. As is known, the current used to energize the solenoid is drawn from the current passing through the limited functionality circuit breakers from a secondary power source.

In this configuration, the shunt trip assembly is, or can be, further structured to be operated remotely. That is, the shunt trip assembly is operatively coupled to a remote actuator that is structured to energize the solenoid so that an operator at the remote location can cause the circuit breaker to open. That is, a remote operator is able to actuate the operating mechanism. Other electronics and assemblies are structured to allow the remote operator to move the operating mechanism from the second configuration to the first configuration so that the contacts can be opened from the remote location in the event of maintenance or for emergency disconnect.

More specifically, shunt trip assemblies also include a housing assembly, a limited functionality breaker mechanism and the tripping mechanism, i.e., the solenoid and a mechanical coupling to the operating mechanism. Generally, the housing assembly includes a plurality of mounting panels. As used herein, a "mounting panel" means a generally planar construct including a number of protrusions extending from one or both planar surfaces. As is known, the protrusions are structured to be coupled to other elements of the shunt trip assembly. That is, for example, a protrusion is structured to be an axle for a moving element of the limited functionality breaker mechanism. Known housing assemblies for shunt trip assemblies typically include three mounting panels; two outer mounting panels that are also the outer planar walls of the housing assembly and a middle, or central, mounting panel disposed between the two outer mounting panels. The middle mounting panel separates the housing assembly into chambers; one chamber for the limited functionality breaker mechanism acting as a switch and one chamber for the tripping mechanism.

When used with a miniature circuit breaker, such a housing assembly has problems. That is, miniature circuit breakers are, typically, disposed in an enclosure having limited space. A shunt trip assembly with three mounting panels is as large as, or almost as large as, a miniature circuit breaker. Such a housing assembly occupies too much space in the enclosure. This is a problem. Further, molding a mounting panel is expensive. Thus, a housing assembly with three mounting panels is a problem due to the cost. Additional problems with the housing assembly are noted below.

The limited functionality breaker mechanism is structured to de-energize the solenoid. That is, in one configuration, the solenoid draws power from the current passing through the limited functionality circuit breaker from the secondary power source. The limited functionality breaker mechanism utilizes an operating mechanism and a bimetal strip, as described above. The limited functionality breaker mechanism operating mechanism is operatively coupled to the operating mechanism of the associated circuit breaker(s). That is, the limited functionality breaker mechanism operating mechanism and the operating mechanism of the associated circuit breaker(s) are operatively coupled so that the two operating mechanisms are in the same configuration. Thus, if the limited functionality breaker mechanism is tripped by solenoid actuation, both the limited functionality breaker mechanism operating mechanism and the associated circuit breakers' operating mechanisms move from the second configuration to the first configuration.

This is a problem because, unlike the bimetal strip of the circuit breakers, the limited functionality breaker mechanism bimetal strip is not calibrated to bend at a specific rate. This results in different latching positions in the limited functionality breaker of the shunt device and in the coupled associated circuit breaker(s). This sometime results in re-latching issues in coupled pair of operating mechanisms. This is a problem.

Further, as noted above, the limited functionality breaker mechanism operating mechanism is operatively coupled to the associated circuit breakers. This is, typically, accomplished via a mechanical link through the shunt trip assembly housing assembly as well as the circuit breaker housing assembly. That is, the shunt trip assembly housing assembly and the limited functionality breaker housing assembly define a passage between the enclosed spaces defined by the housing assemblies. In certain embodiments, the plunger of the shunt trip assembly extends through such a passage. This passage allows heated gases (which are generated when the contacts separate) to pass from the circuit breakers to the shunt trip assembly. This is a problem as the gases damage the elements of the other electrical components housed in the other chamber having the tripping mechanism.

Further, the limited functionality breaker mechanism generally includes a large number of elements, i.e., typically more than twenty, that must be assembled. Thus, the limited functionality breaker mechanism is expensive and time consuming to assemble.

This is another problem with known shunt trip assemblies.

Further, in known shunt trip assemblies, the solenoid is operatively coupled to the limited functionality breaker mechanism. That is, as the solenoid is structured to move the limited functionality breaker operating mechanism from the second configuration to the first configuration, and, as the limited functionality breaker mechanism is operatively coupled to the circuit breaker operating mechanisms, known shunt trip assemblies are, typically, structured so that the solenoid operatively engages the limited functionality breaker mechanism which, in turn, operatively engages the circuit breaker operating mechanisms. Thus, this two-step process means that, when the solenoid is used to open the circuit breakers, there is an undesirable delay in opening. As circuit breakers are intended to move the movable contacts into the first position as quickly as possible, this delay is a problem.

Accordingly, there is, therefore, room for improvement in electrical switching apparatus, such as circuit breakers, and in shunt trip assemblies therefor.

SUMMARY OF THE INVENTION

These needs, and others, are met by at least one embodiment of the disclosed and claimed concept which provides a shunt trip assembly structured to be operatively coupled to a number of circuit breakers. The shunt trip assembly includes a housing assembly and an actuating assembly. The actuating assembly includes a limited number of components. In another embodiment, the shunt trip assembly housing assembly is a substantially sealed housing assembly. In another embodiment, the shunt trip assembly housing assembly includes a single mounting panel.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1A:
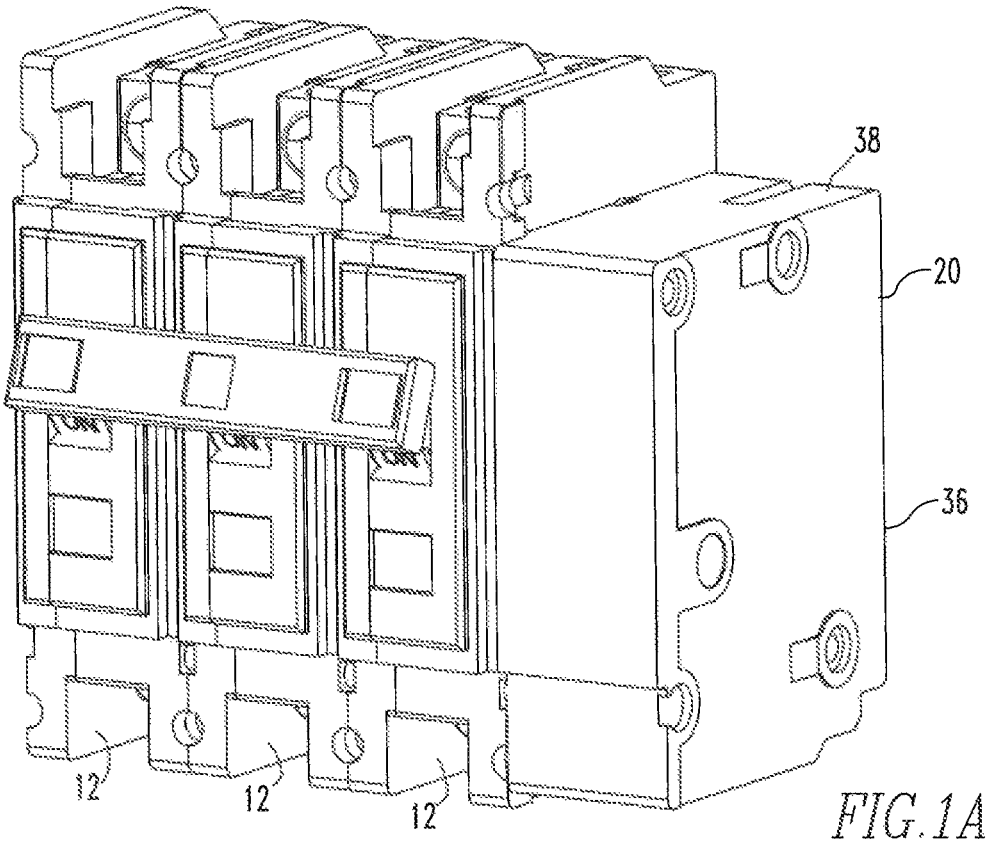
FIGS. 1A and 1B are isometric views of a circuit breaker installation.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of"a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, in a term such as, but not limited to, "[X] structured to [verb][Y]," the "[Y]" is not a recited element. Rather, "[Y]" further defines the structure of "[X]." That is, assume in the following two examples "[X]" is "a mounting" and the [verb] is "support." In a first example, the full term is "a mounting structured to support a flying bird." That is, in this example, "[Y]" is "a flying bird." It is known that flying birds, as opposed to swimming/walking birds, typically grasp a branch for support. Thus, for a mounting, i.e., "[X]," to be "structured" to support a flying bird, the mounting is shaped and sized to be something a flying bird is able to grasp similar to a branch. This does not mean, however, that the flying bird is being recited. In a second example, "[Y]" is a house; that is, the second exemplary term is "a mounting structured to support a house." In this example, the mounting is structured as a foundation as it is well known that houses are supported by foundations. As before, a house is not being recited, but rather defines the shape, size, and configuration of the mounting, i.e., the shape, size, and configuration of "[X]" in the term "[X] structured to [verb] [Y]."

As used herein, "associated" means that the elements are part of the same assembly and/or operate together, or, act upon/with each other in some manner. For example, an automobile has four tires and four hubcaps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component includes a nut (as well as an opening through which the bolt extends) or threaded bore.

As used herein, a "fastener" is a separate component structured to couple two or more elements. Thus, for example, a bolt is a "fastener" but a tongue-and-groove coupling is not a "fastener." That is, the tongue-and-groove elements am part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true. With regard to electronic devices, a first electronic device is "operatively coupled" to a second electronic device when the first electronic device is structured to, and does, send a signal or current to the second electronic device causing the second electronic device to actuate or otherwise become powered or active.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours. With regard to elements/assemblies that are movable or configurable, "corresponding" means that when elements/assemblies are related and that as one element/assembly is moved/reconfigured, then the other element/assembly is also moved/reconfigured in a predetermined manner. For example, a lever including a central fulcrum and elongated board, i.e., a "see-saw" or "teeter-totter," the board has a first end and a second end. When the board first end is in a raised position, the board second end is in a lowered position. When the board first end is moved to a lowered position, the board second end moves to a "corresponding" raised position. Alternately, a cam shaft in an engine has a first lobe operatively coupled to a first piston. When the first lobe moves to its upward position, the first piston moves to a "corresponding" upper position, and, when the first lobe moves to a lower position, the first piston, moves to a "corresponding" lower position.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces with an edge surface extending therebetween. The perimeter, and therefore the edge surface, may include generally straight portions, e.g., as on a rectangular planar member such as on a credit card, or be curved, as on a disk such as on a coin, or have any other shape.

As used herein, the word "unitary" means a component that is created as a single piece or unit. That is, a component that includes pieces that are created separately and then coupled together as a unit is not a "unitary" component or body.

As used herein, "unified" means that all the elements of an assembly are disposed in a single location and/or within a single housing, frame or similar construct.

As used herein, the term "number" shall mean one or an integer greater than one (i.e., a plurality). That is, for example, the phrase "a number of elements" means one element or a plurality of elements. Itis specifically noted that the term "a 'number' of [X]" includes a single [X].

As used herein, a "radial side/surface" for a circular or cylindrical body is a side surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to, or along, a central longitudinal axis of the cylinder.

As used herein, a "tension member" is a construct that has a maximum length when exposed to tension, but is otherwise substantially flexible, such as, but not limited to, a chain or a cable.

As used herein, "generally curvilinear" includes elements having multiple curved portions, combinations of curved portions and planar portions, and a plurality of linear/planar portions or segments disposed at angles relative to each other thereby forming a curve.

As used herein, an "elongated" element inherently includes a longitudinal axis and/or longitudinal line extending in the direction of the elongation.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "by a large amount or degree" relevant to the term being modified as would be understood by one of ordinary skill in the art.

As used herein, "at" means on and/or near relevant to the term being modified as would be understood by one of ordinary skill in the art.

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as NFC, blue tooth, etc. and should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

As used herein, "magnetic" means either a permanent magnet/electromagnet and/or a ferromagnetic construct associated with a magnet. Thus, for example, a plurality of "magnetic" members may include all permanent magnets or a combination of at least one permanent magnet and other ferromagnetic members.

As used herein, "automatic" means a construct that operates without human input/action. A construct is "automatic" even if it needs a human to initially set it up or install it and/or perform maintenance or calibration so long as the construct generally performs thereafter without human input/action.

Figure 1B:
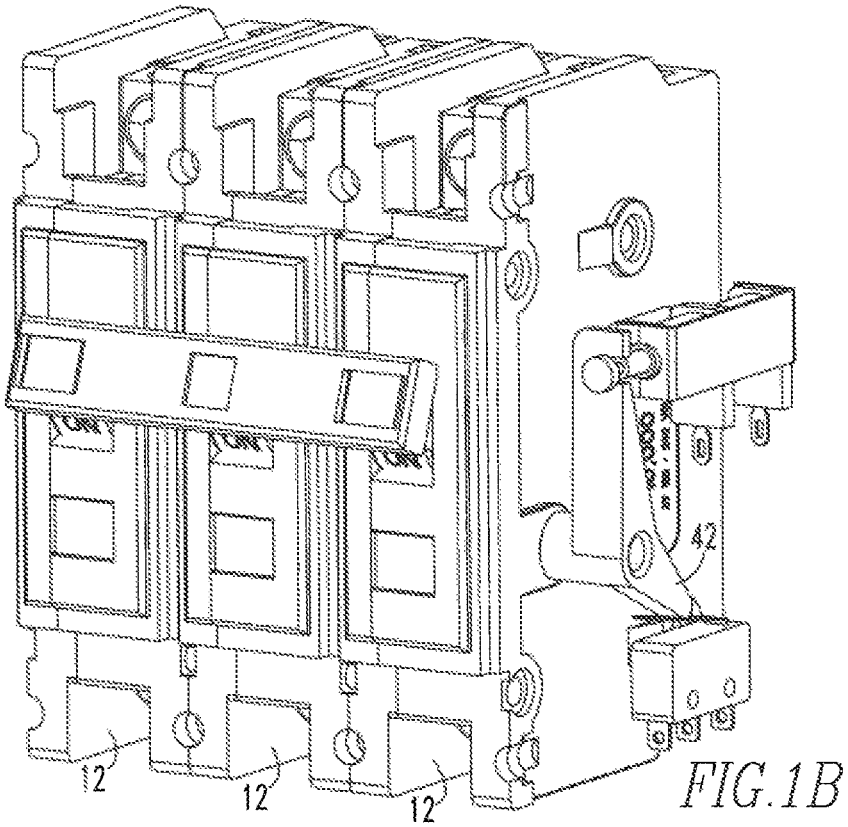
Figure 2:
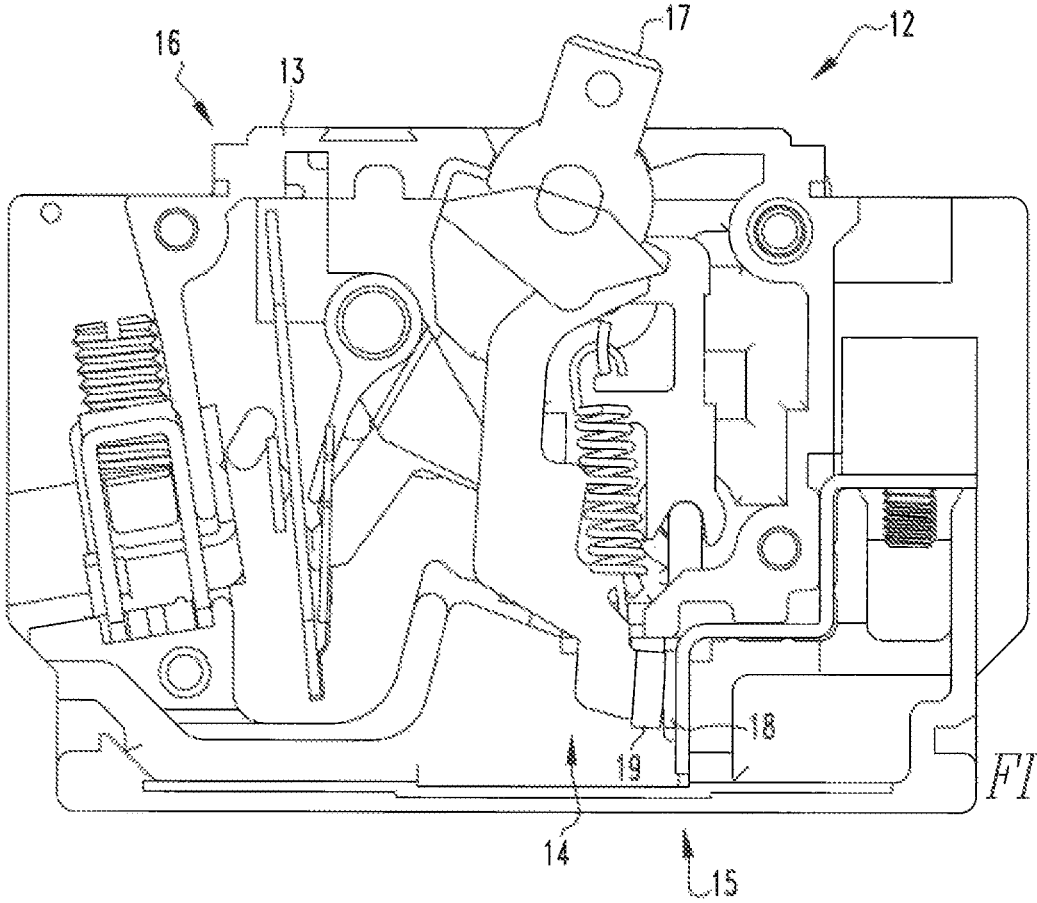
FIG. 2 is a side view without a cover of a circuit breaker with the movable contact in the second position.
Figure 4:
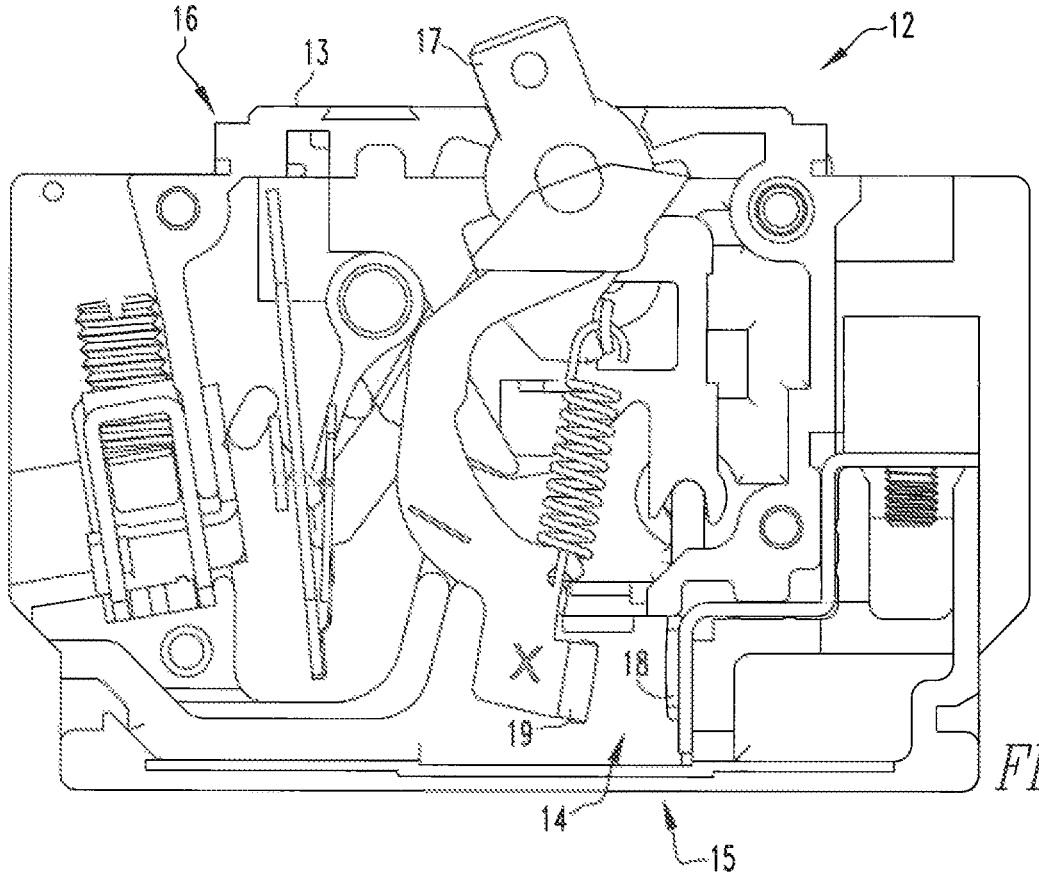
FIG. 4 is a side view without a cover of a circuit breaker with the movable contact in the open, first position following a manual opening by the handle in an OFF state of the circuit breaker.
Figure 6:
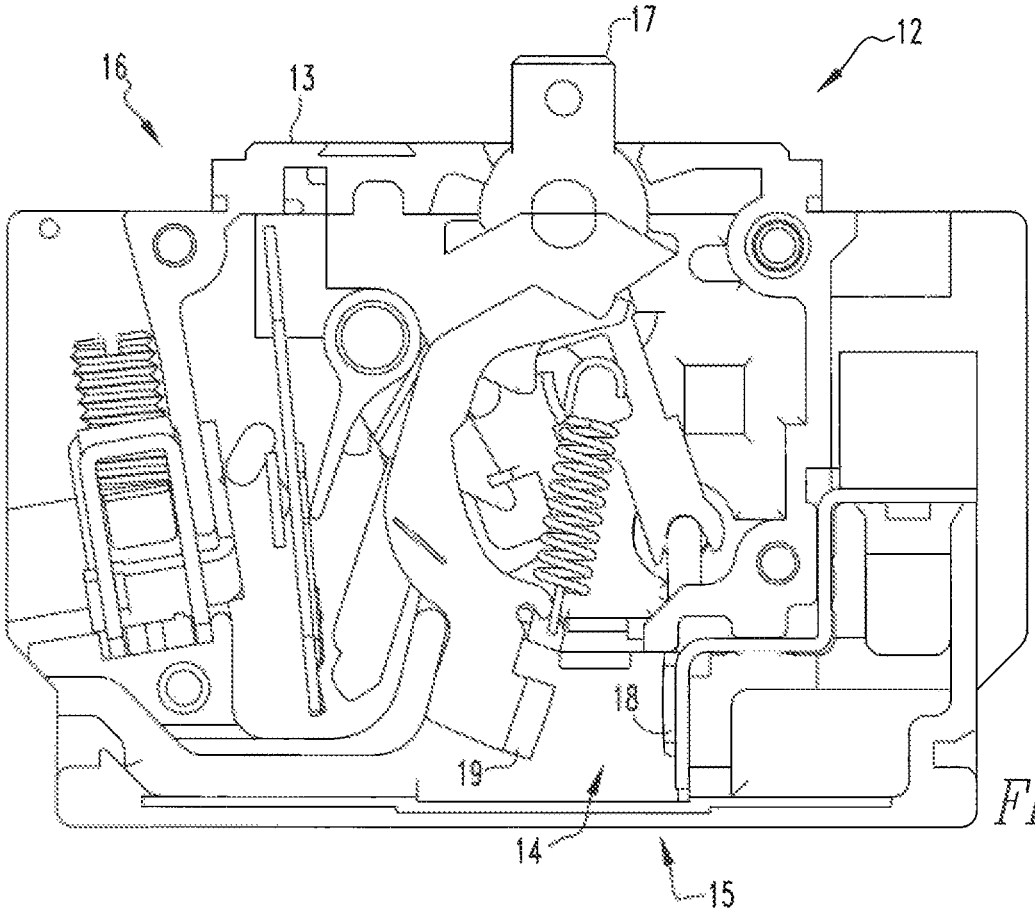
FIG. 6 is a side view without a cover of a circuit breaker with the movable contact in the tripped, first position and the trip device in a de-latch condition, indicating a TRIP state of the breaker.
Figure 12:
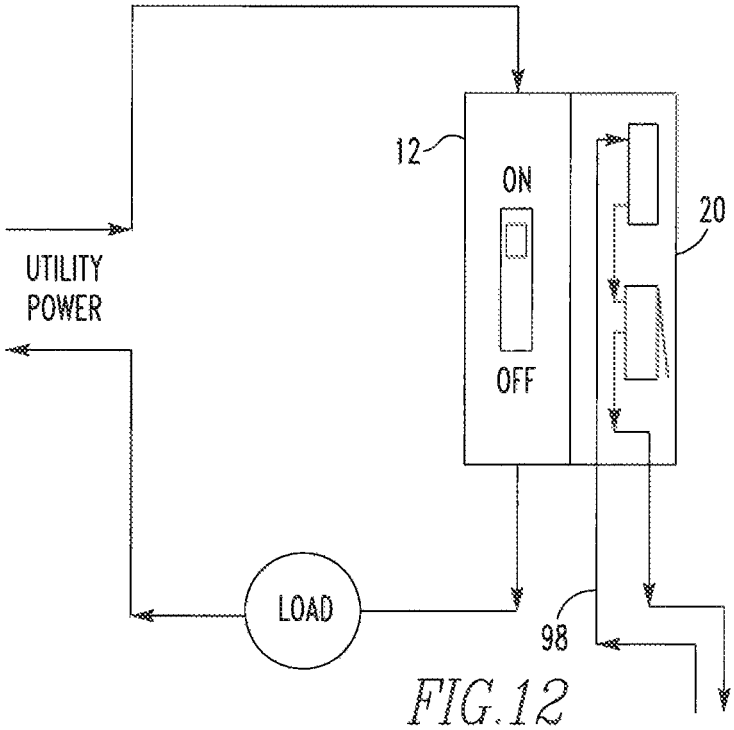
FIG. 12 is a depiction of a circuit arrangement of the shunt trip of FIGS. 3-10 with a single circuit breaker.
Figure 14:
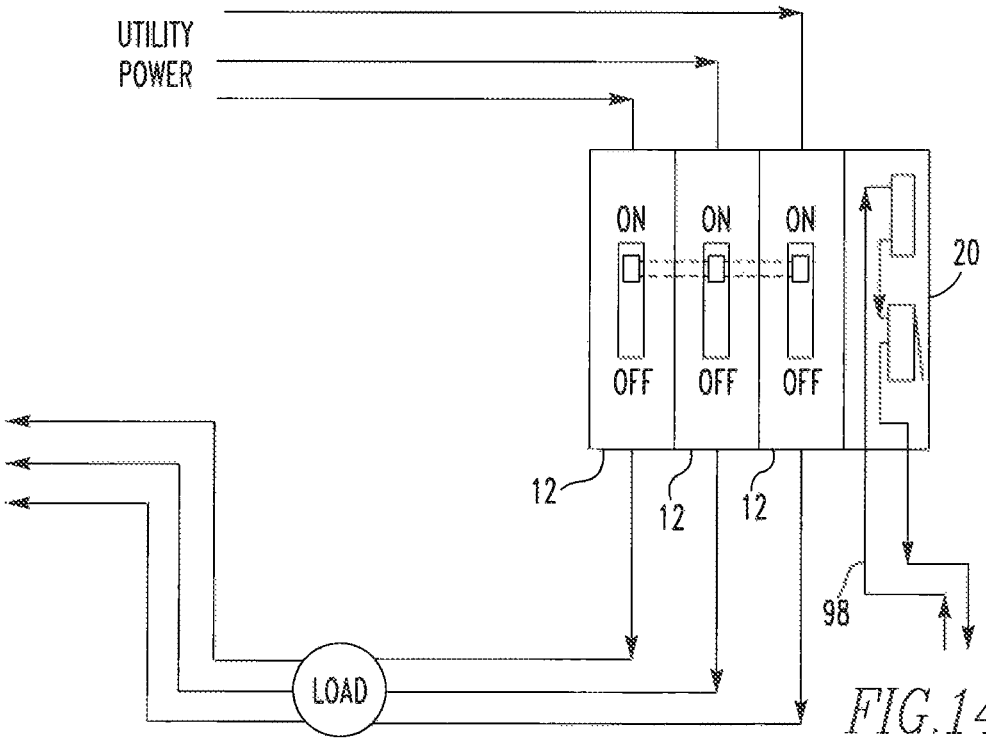
FIG. 14 is a depiction of a circuit arrangement of the shunt trip of FIGS. 3-10 with a gang of three circuit breakers.

As shown in FIGS. 1A and 1B, a circuit breaker installation 10 includes a number of circuit breakers 12 (three shown) and a shunt trip assembly 20. As is known, the circuit breaker installation 10 is disposed in an enclosure (not shown) wherein the circuit breaker installation 10 is in electrical communication with a number of conductive members such as, but not limited to, line and load conductors as shown in FIGS. 12 and 14. As shown in FIGS. 2, 4, and 6, the circuit breakers 12 include a housing assembly 13, an operating mechanism 14, a conductor assembly 15 having a number of pairs of separable contacts (not numbered), and a trip assembly 16. Each circuit breaker operating mechanism 14 includes a handle 17. As is known, each circuit breaker pair of separable contacts includes a fixed contact 18 (or "stationary" contact 18) and a movable contact 19. Each circuit breaker operating mechanism 14 is structured to move the movable contact 19 between a first position (FIGS. 4 and 6), wherein the movable contact 19 is spaced from, and not in electrical communication with, the fixed contact 18, and, a second position (FIG. 2), wherein the movable contact 19 is directly coupled to, and in electrical communication with, the fixed contact 18. As is known, when the movable contact 19 is in the first position, the circuit breaker 12 is said to be "open," and, when the movable contact 19 is in the second position, the circuit breaker 12 is said to be "closed." Further, and as is known, the circuit breaker 12 is in the open configuration following either a manual opening (FIG. 4) or following an overcurrent condition and tripped by the trip assembly 16 (FIG. 6).

That is, the circuit breaker operating mechanism 14 is operatively coupled to the movable contact 19 and is structured to move the movable contact 19. Thus, the circuit breaker operating mechanism 14 moves between at least two configurations, an open, first configuration and a closed, second configuration corresponding to the movable contact 19 positions. Further, and as is known in an exemplary embodiment, the circuit breaker operating mechanism 14 also is configurable in a tripped configuration (wherein the movable contact is in the first position) and a reset configuration.

Further, each circuit breaker housing assembly 13 includes a passage (not shown) on at least one lateral sidewall (a "lateral" sidewall, as used herein, is a sidewall immediately adjacent another circuit breaker housing assembly sidewall) whereby a mechanical linkage (not shown) extends between adjacent circuit breaker operating mechanisms. The mechanical linkage is structured to, and does, operatively couple the adjacent circuit breaker operating mechanisms 14 so that all circuit breaker operating mechanisms 14 are in the same configuration. The handle of associated breakers is also mechanically coupled through the handle tie. That is, if one circuit breaker operating mechanism 14 moves from the second configuration to the first configuration, due to the coupled handle between breakers, the other two circuit breaker operating mechanisms 14 also move from the second configuration to the first configuration.

As is also known, the circuit breaker trip assembly 16 is structured to detect an overcurrent condition and to automatically move the associated circuit breaker operating mechanism 14, or to allow the associated circuit breaker operating mechanism 14 to move, from the second configuration to the first configuration particularly to the trip position as shown in FIG. 6. That is, as noted above, in an exemplary embodiment, each circuit breaker operating mechanism 14 includes a biasing device such as, but not limited to, a number of springs (not numbered), that biases the circuit breaker operating mechanism 14 to the first configuration. The circuit breaker trip assembly 16 includes a number of latch members (not numbered) that are disposed in the path of travel of a circuit breaker operating mechanism component (not numbered). When an overcurrent condition is detected, the latch member moves out of the circuit breaker operating mechanism component path of travel thereby allowing the biasing device to move the circuit breaker operating mechanism 14 from the second configuration to the first configuration particularly to the trip position as shown in FIG. 6. In this condition the handle of the breaker is also moved to the middle position indicating the internal trip of the operating mechanism in tri-stable operating mechanism breaker.

Figure 3:
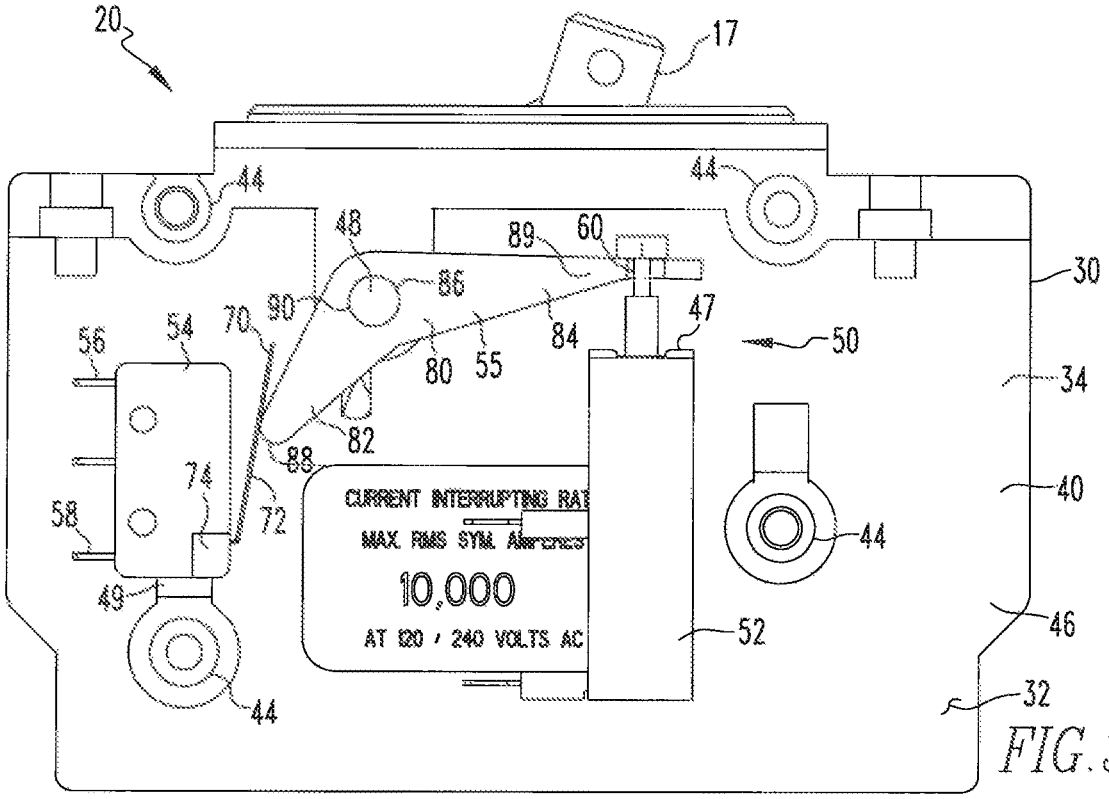
FIG. 3 is another side view without a cover of a shunt trip assembly when the circuit breaker movable contact is in the second position.
Figure 5:
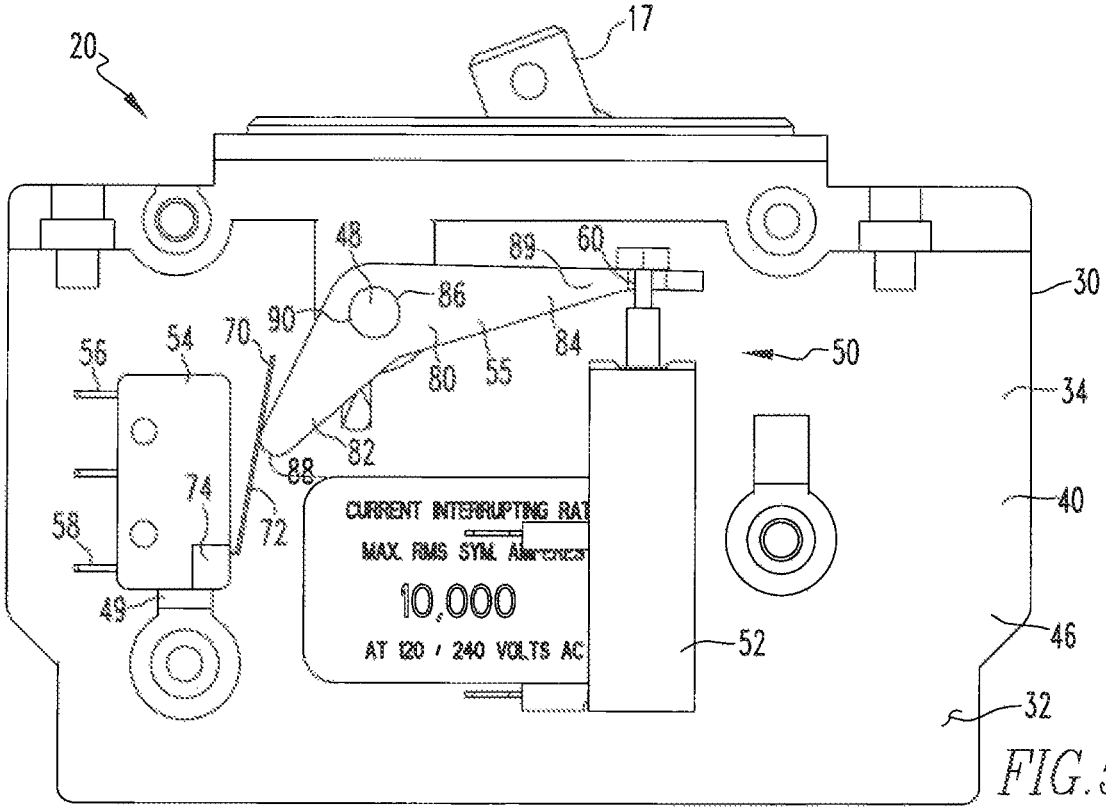
FIG. 5 is another side view without a shunt housing of a shunt trip assembly when the circuit breaker movable contact is in the first position following a manual opening by the circuit breaker handle.
Figure 7:
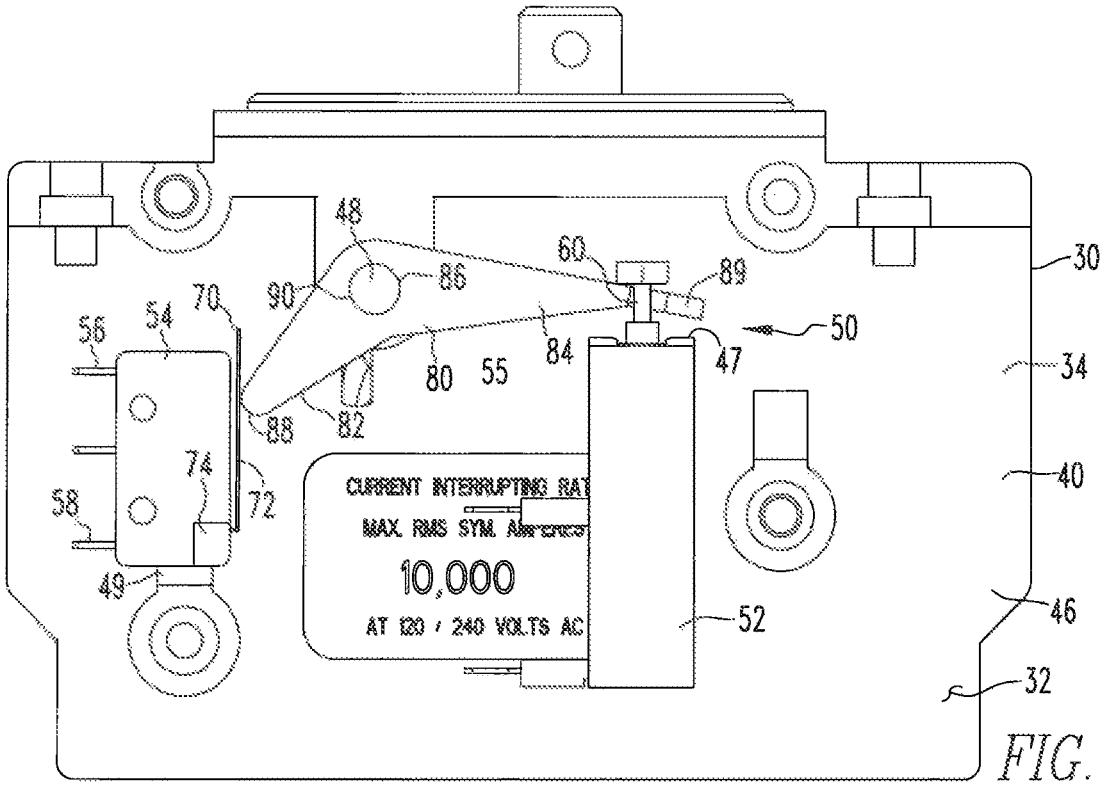
FIG. 7 is a side view without a shunt housing of a shunt trip assembly when the circuit breaker movable contact is in the tripped, first position.

The shunt trip assembly 20 is structured to move the adjacent circuit breaker operating mechanism 14 from the second configuration to the first configuration. Further, and due to the configuration described above, the other two circuit breaker operating mechanisms also move from the second configuration to the first configuration. As shown in FIGS. 3, 5, and 7, the shunt trip assembly 20 includes a housing assembly 30 and an actuating assembly 50.

The shunt trip assembly housing assembly 30 defines a substantially enclosed space 32. That is, in an exemplary embodiment, the shunt trip assembly housing assembly 30 includes two wide, generally planar members 34, 36 (or first planar member 34 and second planar member 36 (FIG. 1)) as well as four narrow, generally planar members 38 (i.e., the narrow, generally planar members are collectively or individually identified by reference number 38). The narrow, generally planar members 38 (FIG. 1) are disposed at the perimeter of one wide, generally planar member 34, 36 and depend therefrom. That is, the narrow, generally planar members 38 extend generally perpendicular to the wide, generally planar members 34, 36. Alternately, each wide, generally planar member 34, 36 includes a portion (an in an exemplary embodiment, half) of each narrow, generally planar member 38 which, when brought together, form the narrow, generally planar members 38. That is, the shunt trip assembly housing assembly 30 is formed when the wide, generally planar members 34, 36 are disposed in spaced, generally parallel planes with the narrow, generally planar members 38 extending therebetween.

In an exemplary embodiment, the shunt trip assembly housing assembly 30 is a "substantially sealed housing assembly." As used herein, a "substantially sealed housing assembly" means a housing assembly wherein there are no "generally unblocked passages" on a housing assembly lateral sidewall. As used herein, a "generally unblocked passage" means a passage wherein nothing extends through the passage, or, wherein an object extending through the passage has a substantially smaller cross-sectional area than the passage. For example, in the prior art, a circuit breaker housing assembly included passages for a solenoid plunger and/or a passage for a braided wire to pass through a lateral sidewall. The solenoid plunger and/or braided wire had a substantially smaller cross-sectional area than the associated passage and, as such, these passages were "generally unblocked passages" and the housing assembly was not a "substantially sealed housing assembly." Conversely, a generally circular passage for a generally circular axle, such as, but not limited to, an axle that operatively couples adjacent circuit breaker operating mechanisms, wherein the axle has substantially the same cross-sectional area as the passage is not, as used herein, a "generally unblocked passage." Similarly, a passage defined by a tubular construct that is structured to, and does, abut a similar tubular construct within the housing assembly is not, as used herein, a "generally unblocked passage."

In an exemplary embodiment, the shunt trip assembly housing assembly 30 includes a lateral sidewall 40 (which is also the first planar member 34, as shown) having a single generally circular protrusion (a lever member axle 48) which is in alignment with the associated circuit breaker circular axle to ease for coupling between the lever and the circuit breaker axle. As described below, a the lever member body rotational coupling base 92 and/or lever member body rotational coupling external coupling component 96 is structured to, and does, extend through the shunt trip assembly housing. The lever member body rotational coupling base 92 and/or lever member body rotational coupling external coupling component 96 has substantially the same cross-sectional area as the circuit breaker lateral sidewall passage 91. Further, the shunt trip assembly housing assembly 30 includes a number (four shown) of passages (not numbered) defined by tubular members 44 that extend generally perpendicular to the plane of the wide, generally planar members 34, 36. The tubular members 44 abut each other in the shunt trip assembly housing assembly enclosed space 32 and are not, as used herein, "generally unblocked passages." As is known, the tubular members 44 define passages for fasteners (not shown) that are structured to couple the planar members 34, 36 together or to other elements such as, but not limited to the circuit breakers 12.

Thus, when assembled, the shunt trip assembly housing assembly 30 is a "substantially sealed housing assembly." As noted above, a housing assembly that allows gases to pass therethrough is a problem. As used herein, a "substantially sealed housing assembly" does not allow more than a negligible amount of gas to pass therethrough. Thus, a shunt trip assembly housing assembly 30 that is a "substantially sealed housing assembly" solves the problem(s) noted above.

Further, in an exemplary embodiment, a single wide, generally planar member 34 (i.e., the first wide, generally planar member 34 as shown) is a "mounting panel" 46 as defined above. Thus, the second wide, generally planar member 36 is also a substantially planar member in that, other than the narrow, generally planar members 38 and/or the tubular members 44 (if included), the second wide, generally planar member 36 does not have any protrusions except for the fastening zone to have the air gap between the shunt device and next mounted product. As noted above, a housing assembly with a plurality of mounting panels is a problem; thus, a shunt trip assembly housing assembly 30 with a single mounting panel solves the problem(s) noted above.

Further, in an exemplary embodiment, the mounting panel 46 (i.e., first wide, generally planar member 34) includes a solenoid mounting 47, a lever member axle 48, and a micro-switch mounting 49. The solenoid mounting 47 is structured to couple, directly couple, or fix the solenoid 52 (discussed below) to the mounting panel 46. The lever member axle 48 is structured to rotatably coupled a lever member 55 (discussed below) to the mounting panel 46. The micro-switch mounting 49 is structured to couple, directly couple, or fix the micro-switch 54 (discussed below) to the mounting panel 46 by interference fit, snaps or though locking washers.

The shunt trip assembly actuating assembly 50 (hereinafter and as used herein, the "actuating assembly" 50) is structured to actuate the number of circuit breakers 12. As used herein, an actuating assembly "structured to actuate the/a number of circuit breakers" means that the actuating assembly is structured to, and does, move the circuit breaker operating mechanism from the second configuration to the first configuration. Further, the actuating assembly 50 includes a "limited number of components," a "very limited number of components," or an "exceedingly limited number of components." Further, as used herein, the "components" of an "actuating assembly" means the components that are removable from the shunt trip assembly housing assembly 30. That is, for example, the lever member axle 48 is not part of the "actuating assembly components" because the lever member axle 48 is part of the shunt trip assembly housing assembly 30 and cannot be removed therefrom.

In an exemplary embodiment, the actuating assembly 50 includes, or consists of, a solenoid 52, a micro-switch 54, and a lever member 55. As is known, the actuating assembly solenoid 52 (hereinafter and as used herein, the "solenoid" 52) includes a housing, a coil, an electrical circuit (none shown/numbered) and a plunger 60. The solenoid 52 is structured to receive an operating current. That is, the solenoid 52 also includes coupling terminals that are in electrical communication with the coil. As is further known, the solenoid plunger 60 is movably disposed in the housing and the coil. The solenoid plunger 60 is a ferromagnetic construct. When a charge is applied to the solenoid coil, or as used herein, when the solenoid 52 is energized, the solenoid plunger 60 moves relative to the solenoid housing. As shown, and in an exemplary embodiment, the solenoid plunger 60 is structured to move between a retracted, first position, wherein the solenoid plunger 60 is substantially disposed inside the solenoid housing, and, a second position, wherein the solenoid plunger 60 is substantially disposed outside of the solenoid housing. That is, as is known, when the solenoid 52 is de-energized, the solenoid plunger 60 is in the second position. Conversely, when the solenoid 52 is energized, the solenoid plunger 60 is in the first position. As is known, the solenoid 52 is configured and/or includes additional constructs (none shown) structured to move the solenoid plunger 60 from the first position to the second position. The positioning of the solenoid 52 from the shunt trip housing assembly 30 is maintained such that the plunger 60 is more inside the solenoid 52, for greater force of actuation. The distance "X" can be optimized by changing the lever arm length contributing to mechanical advantage versus solenoid plunger stroke/position inside the solenoid 52 for the initial pull force. The more the plunger 60 is inside the solenoid 52, the greater the pull force. At the same time, the more the lever arm length, the less force is required to actuate the circuit breaker axle, but this eventually increases the plunger 60 stroke. So optimization is arrived using any of a variety of known principles.

The actuating assembly micro-switch 54 (hereinafter and as used herein, the "micro-switch" 54) is structured as an electrical switch. That is, the micro-switch 54 is structured to, and does, selectively transmit a solenoid operating current, discussed below, to the solenoid 52. The micro-switch 54 includes a housing, a conductor assembly structured to selectively interrupt a current and an actuator 70. As is known, the micro-switch conductor assembly is substantially disposed inside the micro-switch housing. The micro-switch conductor assembly is structured to move between a first configuration, wherein the micro-switch conductor assembly is structured to interrupt a current, and a second configuration, wherein the micro-switch conductor assembly is structured to allow a current to pass through the micro-switch 54. That is, in an exemplary embodiment, the micro-switch conductor assembly includes a movable contact and a fixed contact. The micro-switch conductor assembly movable contact is structured to move between a first position, wherein the micro-switch conductor assembly movable contact is spaced from, and not in electrical communication with, the micro-switch conductor assembly fixed contact, and, a second position, wherein the micro-switch conductor assembly movable contact is directly coupled to, and in electrical communication with, the micro-switch conductor assembly fixed contact. As is further known, the micro-switch conductor assembly include terminals 56, 58 disposed outside the micro-switch housing. Further, in an exemplary embodiment, the micro-switch conductor assembly is in the second configuration during normal operation of the circuit breaker installation 10.

Thus, the micro-switch 54 is structured to be, and is, in electrical communication with a selectively energized power source, such as, but not limited to, the solenoid 52, via the terminals 56, 58. It is understood that when the micro-switch conductor assembly is in the first configuration, power is not transmitted through the micro-switch 54. Conversely, when the micro-switch conductor assembly is in the second configuration, power is transmitted through the micro-switch 54. In an exemplary embodiment, while the micro-switch conductor assembly is in the second configuration during normal operation of the circuit breaker installation 10, the selectively applied energy is not applied during normal operation of the circuit breaker installation 10. That is, typically, the line coupled to the micro-switch 54 is de-energized and is only energized when selected by a user.

The micro-switch actuator 70 is, in an exemplary embodiment, disposed substantially outside the micro-switch housing and is operatively coupled to the micro-switch conductor assembly. That is, the micro-switch actuator 70 is structured to, and does, move between a first position and a second position corresponding to the micro-switch conductor assembly first configuration and second configuration. That is, for example, when the micro-switch actuator 70 is in the first positon, the micro-switch conductor assembly is in the first configuration and electricity does not pass through the micro-switch 54.

In an exemplary embodiment, the micro-switch actuator 70 includes a pivoting lever 72, i.e., a pivoting actuator 70. As used herein, the micro-switch 54 and/or the micro-switch actuator 70 is in an "unactuated," second position when the micro-switch conductor assembly is in the second configuration. Conversely, and as used herein, the micro-switch 54 and/or the micro-switch actuator 70 is in an "actuated," first position when the micro-switch conductor assembly is in the first configuration.

The actuating assembly lever member 55 (hereinafter, and as used herein, the "lever member" 55) is structured to be coupled to the solenoid 52 and to the micro-switch 54. That is, in an exemplary embodiment as shown, the solenoid 52/solenoid plunger 60 is structured to be, and is, operatively coupled to the lever member 55; thus, the solenoid 52/solenoid plunger 60 is structured to, and does, operatively engage the lever member 55. Further, the lever member 55 is operatively coupled to the micro-switch 54/the micro-switch actuator 70. Thus, the lever member 55 is structured to, and does, operatively engage the micro-switch 54/the micro-switch actuator 70. As used herein, a construct that "operatively engages" a micro-switch is structured to, and does, move the micro-switch conductor assembly between configurations. That is, for example, a construct that applies bias to a micro-switch housing and that does not move the micro-switch conductor assembly between configurations, does not, as used herein, "operatively engage" the micro-switch 54. As used herein, a lever member 55 that is only operatively engaged by a solenoid 52, or similar construct, and, that only operatively engages a micro-switch 54 is a "common lever member."

The lever member 55 includes a body 80 having an elongated first arm 82, an elongated second arm 84 and a rotational coupling 86. In an exemplary embodiment, the lever member body first arm 82 and the lever member body second arm 84 each extend generally radially from the lever member body rotational coupling 86. Further, the lever member body first arm 82 and the lever member body second arm 84 each extend in a plane that is generally perpendicular to the axis of rotation of the lever member body rotational coupling 86. In an exemplary embodiment, the lever member body first arm 82 is about two to three times as long as the lever member body second arm 84. Further, in an exemplary embodiment, the angle between the lever member body first arm 82 and the lever member body second arm 84 is selected to suit the microswitch operating angle and its position from the lever member axle 48.

The lever member body first arm 82 includes a distal end 88 which is the end furthest from the lever member body rotational coupling 86. The lever member body first arm distal end 88 is structured to be, and is, coupled to the solenoid plunger 60. The lever member body second arm 84 also includes a distal end 89 which is structured to, and does, operatively engage the micro-switch pivoting actuator 70.

Figure 8:
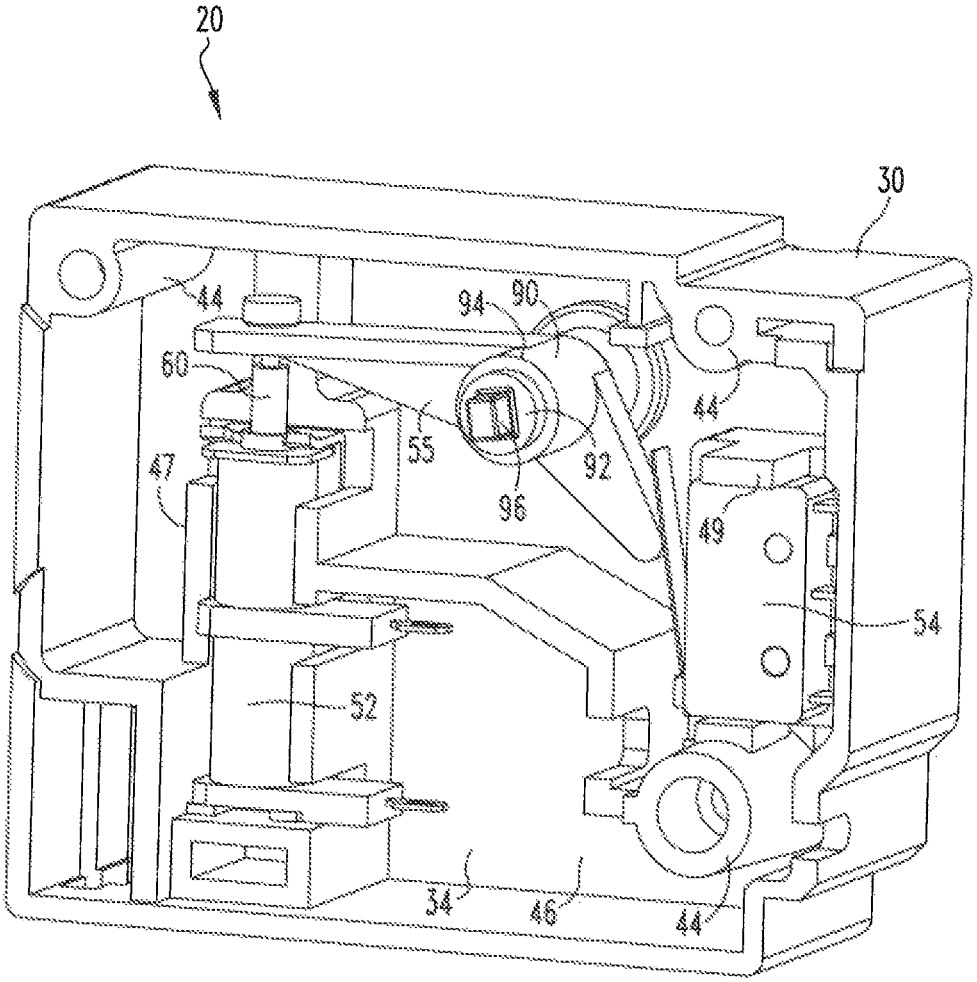
FIG. 8 is an isometric view of a shunt trip assembly.
Figure 9:
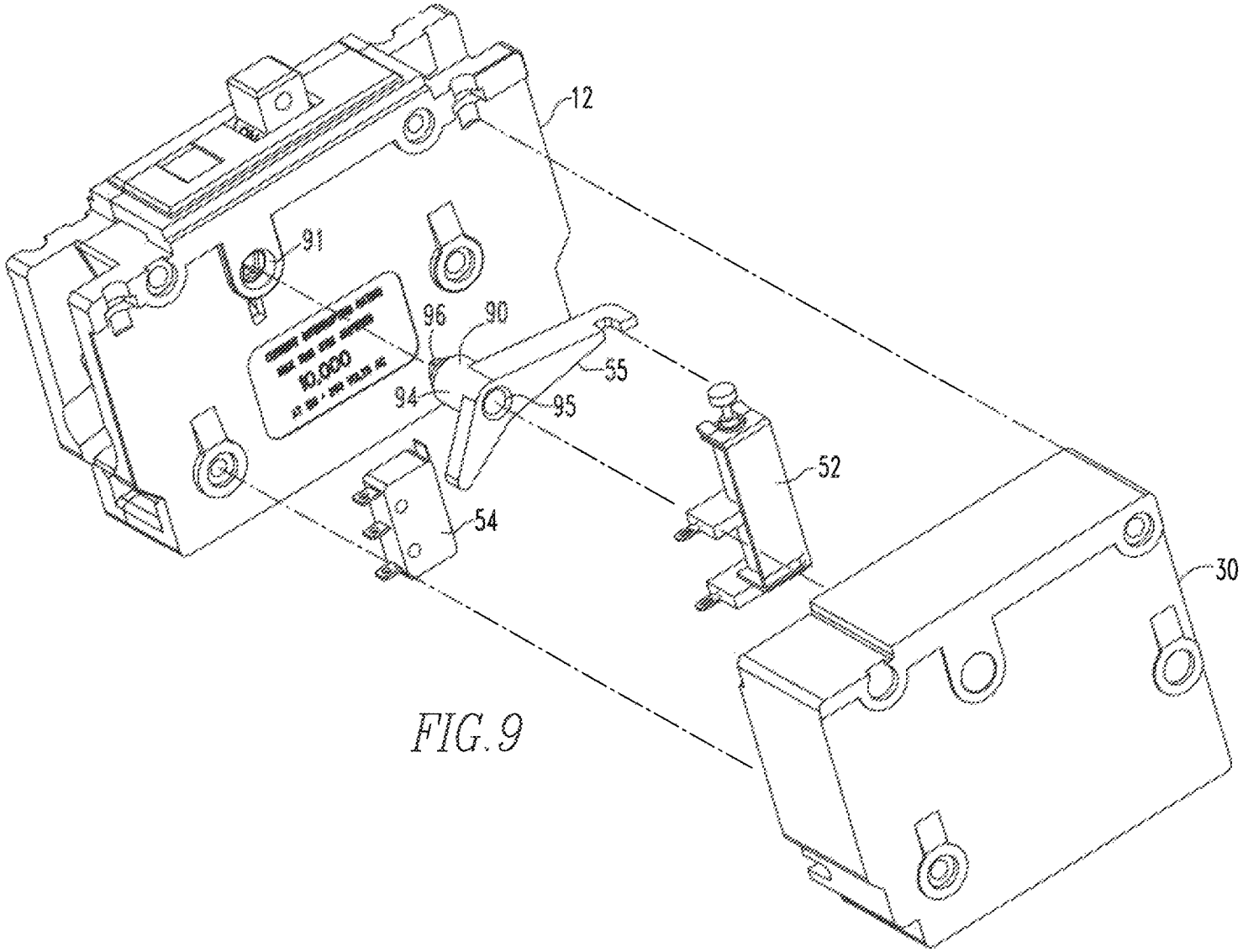
FIGS. 9 and 10 depict the shunt trip assembly in an exploded fashion.
Figure 10:
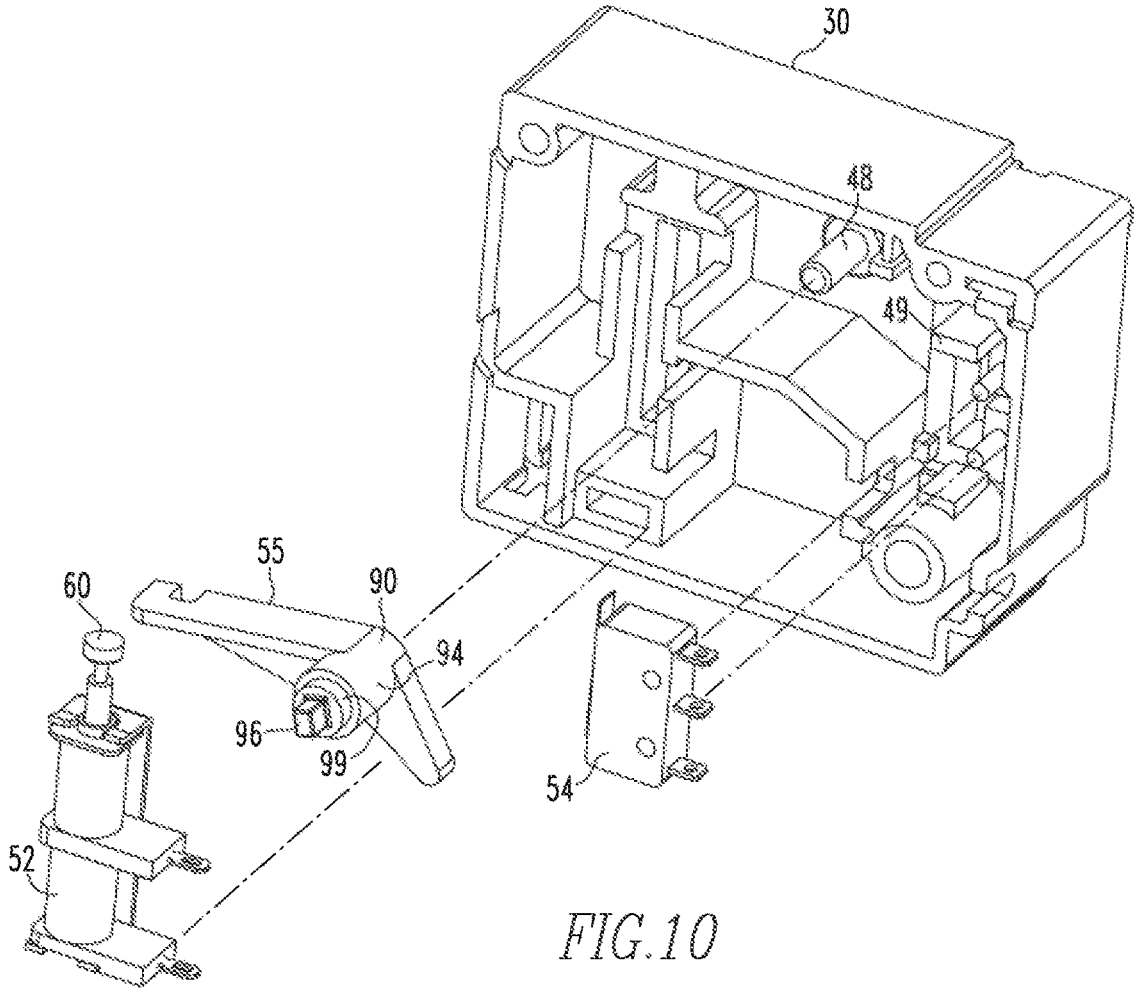

In an exemplary embodiment, the lever member body rotational coupling 86 is a socketed axle. That is, as shown in FIGS. 8-10, the lever member body rotational coupling 86 includes a cup-like generally cylindrical body 90 having a base 92 and a generally cylindrical, depending sidewall 94. As noted above, the mounting panel 46 includes a lever member axle 48. The lever member axle 48 is structured to fit within a receptacle 95 of the lever member body rotational coupling body 90. That is, the lever member axle 48 has a radius that is slightly smaller than the inner diameter of the receptacle 95 of the lever member body rotational coupling body 90 so that the lever member body 80 is structured to be, and is, disposed on the lever member axle 48. In this configuration, the lever member body rotational coupling body 90 is structured to be, and is rotationally coupled to the lever member axle 48. Thus, the lever member 55 is structured to, and does, rotate on the lever member axle 48. In an exemplary embodiment, the lever member body rotational coupling base 92 includes a non-circular, external coupling component 96 that is structured to be, and is, operatively coupled to the operating mechanism of the adjacent circuit breaker 12. That is, the lever member body rotational coupling external coupling component 96 is structured to, and does, extend through the shunt trip assembly housing. The lever member body rotational coupling external coupling component 96 is disposed on the side of the lever member body rotational coupling base 92 opposite the lever member body rotational coupling sidewall 94.

The actuating assembly 50 is assembled as follows. The solenoid 52 is coupled, directly coupled, or fixed to the mounting panel 46 at the solenoid mounting 47. The micro-switch 54 is coupled, directly coupled, or fixed to the mounting panel 46 at the micro-switch mounting 49. The lever member 55 is rotatably coupled to the mounting panel 46 at the lever member axle 48. Further, the lever member body rotational coupling external coupling component 96 extends through the shunt trip assembly housing assembly lateral sidewall passage 42 and is operatively coupled to the operating mechanism of the adjacent circuit breaker 12. As noted above, the lever member body rotational coupling base 92 and/or lever member body rotational coupling external coupling component 96 has substantially the same cross-sectional area as the circuit breaker lateral side wall passage 91 through which it passes. Thus, the shunt trip assembly housing assembly 30 is a "substantially sealed housing assembly."

The solenoid plunger 60 is operatively coupled to the lever member body first arm distal end 88. The lever member 55 is positioned and/or oriented so that the lever member body second arm distal end 89 is adjacent the micro-switch actuator 70. The lever member 55 is further structured to move between two positions, a first position, wherein the lever member 55/lever member body second arm distal end 89 engages the micro-switch actuator 70, and a second positon, wherein the lever member 55/lever member body second arm distal end 89 does not engage the micro-switch actuator 70. The micro-switch 54 is coupled to, and is in electrical communication with, a power source (not shown). The power source is controlled remotely. That is, a user at a remote location selectively applies power to the micro-switch 54. Thus, a current is selectively supplied to the micro-switch 54.

The current that is selectively applied to the micro-switch 54 has sufficient strength to energize the solenoid 52 is, as used herein, the "operating current." In an exemplary embodiment, the operating current is not the current passing through the number of circuit breakers 12. That is, the operating current is not part of the circuit that includes the number of circuit breakers 12. The micro-switch 54 is further placed in electrical communication with the solenoid 52. Thus, the micro-switch 54 is structured to selectively energize/de-energize the solenoid 52. That is, when the operating current is not being applied to the micro-switch 54 and/or when the micro-switch conductor assembly separable contact is in the open, first position, i.e., when the micro-switch actuator 70 is in the first position, the operating current does not pass through the micro-switch 54 and the solenoid 52 is/remains de-energized. Conversely, when the operating current is being applied to the micro-switch 54 and when the micro-switch conductor assembly separable contacts are in the closed, second configuration, i.e., when the micro-switch actuator 70 is in the second position, the operating current passes through the micro-switch 54 and the solenoid 52 is energized.

During the normal operation of the circuit breakers 12, each circuit breaker operating mechanism is in the second configuration. As described above, this means that each circuit breaker movable contact is in the second position. In this configuration, each circuit breaker movable contact is in electrical communication with an associated fixed contact and electricity passes through the circuit breaker 12. Similarly, in the shunt trip assembly 20, the solenoid plunger 60 is in its second position. As described above, this means that the solenoid 52 is de-energized. Further, the lever member 55 is in its second position wherein the lever member 55/lever member body second arm distal end 89 does not engage the micro-switch actuator 70. Thus, the micro-switch actuator 70 is in its second position and the micro-switch 54 is in the corresponding second configuration, wherein electricity is able to pass through the micro-switch 54. In normal use, the operating current is not applied to the micro-switch 54. Thus, the solenoid 52 is de-energized as stated above and the solenoid plunger 60 is in the second position.

When a user wishes to open the circuit breakers 12 using the shunt trip assembly 20, the user selectively applies power to the micro-switch 54. That is, the user selectively applies the operating current to the micro-switch 54. As the micro-switch 54 is in the second configuration, i.e., the micro-switch conductor assembly movable contact is in the closed, second position, the operating current flows through the micro-switch 54 and to the solenoid 52. The solenoid 52 is thereby energized and moves to the solenoid plunger 60 to the first position. As the solenoid plunger 60 is operatively coupled to the lever member 55, the lever member 55 moves from its second position to its first position. Motion of the lever member 55 has two effects. First, as the lever member body rotational coupling 86, i.e., the lever member body rotational coupling external coupling component 96, is operatively coupled to the operating mechanism of the adjacent circuit breaker 12, rotation of the lever member 55 causes the operating mechanism of the adjacent circuit breaker 12 to move from the second configuration to the first configuration. That is, the rotation of the lever member 55 causes the adjacent circuit breaker 12 to trip and/or open. Further, because the operating mechanisms of all the circuit breakers 12 are operatively coupled to each other, the other circuit breakers 12, i.e., the circuit breakers 12 that are not adjacent to the shunt trip assembly 20, are also tripped and/or opened.

Second, the lever member 55/lever member body second arm distal end 89 engages the micro-switch actuator 70 and moves the micro-switch actuator 70 from the second position to the first position. This action moves the micro-switch 54 from the second configuration to the first configuration. That is, the micro-switch conductor assembly separable contact is moved to the open, first position. This, in turn, interrupts the operating current; thus, the solenoid 52 is de-energized. It is noted that, compared to the prior art shunt trip assemblies described above, in this configuration, the shunt trip assembly 20 does not need to operate a limited functionality breaker mechanism. By avoiding this action, and in the configuration described above, the present shunt trip assembly 20 is able to interrupt the current to the solenoid 52 in less than about 0.033 second. This solves the problem(s) stated above.

Figure 11:
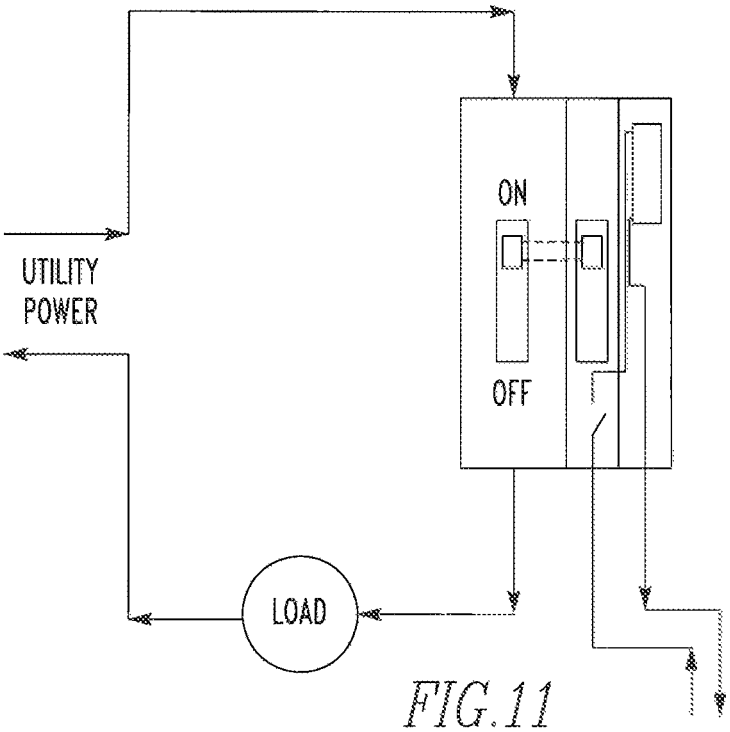
FIG.11 PRIOR ART
FIG. 11 is a depiction of a circuit arrangement of a prior art shunt trip with a single circuit breaker.
Figure 13:
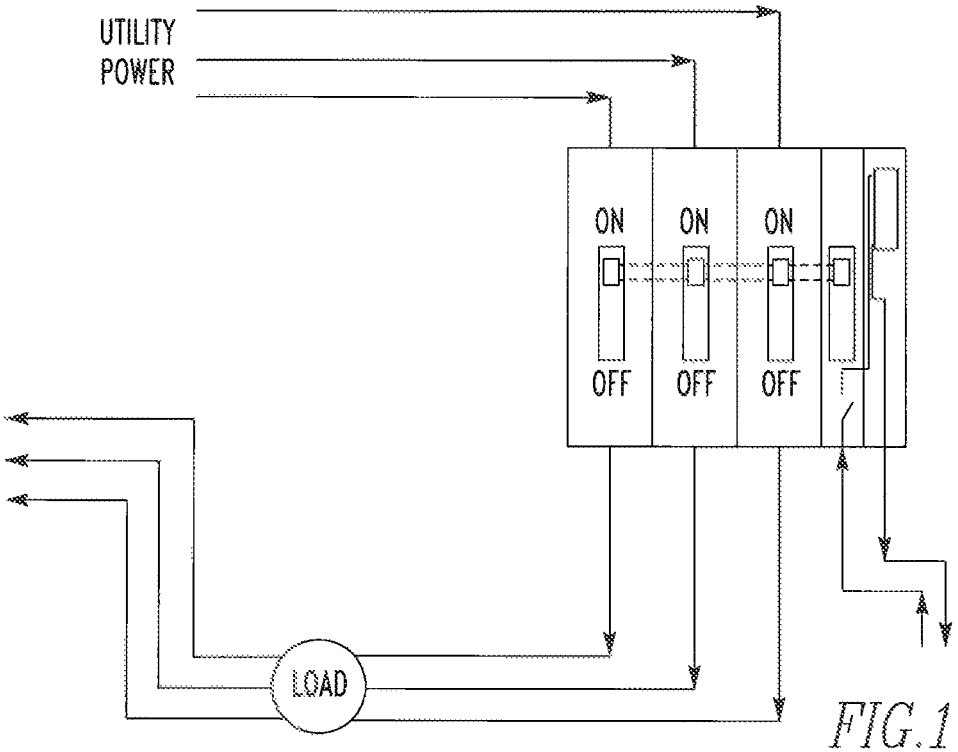
FIG.13 PRIOR ART
FIG. 13 is a depiction of a circuit arrangement of a prior art shunt trip with a gang of three circuit breakers.

FIGS. 11 and 13 depict circuit diagrams of circuit breakers with previous shunt trips. FIGS. 12 and 14 depict, respectively, circuit diagrams of the improved shunt trip 20 with a single circuit breaker 12 and with three circuit breakers 12, and with a separate supply of power to energize the solenoid 52 and thus actuate the shunt trip assembly 20.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A shunt trip assembly structured to be operatively coupled to a number of circuit breakers, said shunt trip assembly comprising:

a shunt trip assembly housing assembly defining a substantially enclosed space and including a lever member axle structured to be operatively coupled to an operating mechanism of the number of circuit breakers;

an actuating assembly including a solenoid, a single micro-switch, and a lever member; and wherein:

said actuating assembly is structured to actuate said number of circuit breakers;

said micro-switch includes a pivoting actuator;

said solenoid includes a solenoid plunger;

said lever member includes a rotational coupling that couples said lever member to said lever member axle;

said lever member includes a first arm extending generally radially from said rotational coupling, said first arm comprising a distal end coupled to said solenoid plunger;

said lever member includes a second arm extending generally radially from said rotational coupling, said second arm comprising a distal end structured to operatively engage said micro-switch pivoting actuator;

said solenoid plunger is structured to move between a first position and a second position;

said micro-switch pivoting actuator is structured to move between a first position, wherein said micro-switch is structured to transmit a solenoid operating current to said solenoid, and a second position, wherein said micro-switch is not structured to transmit a solenoid operating current to said solenoid;

said lever member is structured to move between a first position, wherein said lever member does not operatively engage said micro-switch pivoting actuator, and a second position, wherein said lever member operatively engages said micro-switch pivoting actuator; and said solenoid plunger is operatively coupled to said lever member and is structured to move said lever member between said lever member first position and said lever member second position.

2. The shunt trip assembly of claim 1 wherein said lever member is a common lever member.

3. The shunt trip assembly of claim 1:

wherein said lever member body first arm is longer than said lever member body second arm.

4. The shunt trip assembly of claim 1 wherein:

said micro-switch is structured to selectively transmit said solenoid operating current to said solenoid;

said solenoid is structured to receive said solenoid operating current;

wherein said micro-switch is structured to be in a second configuration wherein a solenoid operating current passes therethrough to said solenoid;

wherein said solenoid is structured to be actuated upon receiving said solenoid operating current and thereby move said lever member from said lever member first position to said lever member second position;

wherein movement of said lever member from said lever member first position to said lever member second position causes said lever member to operatively engage said micro-switch pivoting actuator and change said micro-switch to a first configuration wherein said solenoid operating current does not pass therethrough; and wherein said solenoid is de-energized.

5. A shunt trip assembly structured to be operatively coupled to a number of circuit breakers, said shunt trip assembly comprising:

a shunt trip assembly housing assembly defining a substantially enclosed space;

an actuating assembly including a limited number of components; and said actuating assembly structured to actuate said number of circuit breakers;

wherein said actuating assembly limited number of components includes a solenoid, a micro-switch, and a lever member;

wherein:

said lever member includes a body having a first arm, a second arm and a rotational coupling;

said lever member body first arm extending generally radially from said lever member body rotational coupling;

said lever member body second arm extending generally radially from said lever member body rotational coupling; and wherein said lever member body first arm is longer than said lever member body second arm;

wherein:

said solenoid includes a plunger;

said micro-switch includes a pivoting actuator;

said lever member body first arm includes a distal end;

said lever member body first arm distal end structured to be coupled to said solenoid plunger;

said lever member body second arm includes a distal end; and said lever member body second arm distal end structured to operatively engage said micro-switch pivoting actuator;

wherein:

said micro-switch is structured to selectively transmit a solenoid operating current to said solenoid;

said solenoid is structured to receive an operating current;

said lever member is structured to move between a first position, wherein said lever member does not operatively engage said micro-switch, and, a second position, wherein said lever member operatively engages said micro-switch;

said solenoid is operatively coupled to said lever member and is structured to move said lever member between said lever member first position and said lever member second position;

wherein said micro-switch is structured to be in a second configuration wherein a solenoid operating current passes therethrough to said solenoid;

wherein said solenoid is structured to be actuated upon receiving an operating current and thereby move said lever member to said lever member second position;

wherein said lever member is structured to operatively engage said micro-switch and change said micro-switch to a first configuration wherein a solenoid operating current does not pass therethrough; and wherein said solenoid is de-energized;

wherein:

said solenoid plunger is structured to move between a first position and a second position;

said micro-switch pivoting actuator is movable between a first position, wherein said micro-switch is structured to transmit a solenoid operating current to said solenoid, and, a second position, wherein said micro-switch is not structured to transmit a solenoid operating current to said solenoid;

said lever member is structured to move between a first position, wherein said lever member does not operatively engage said micro-switch pivoting actuator, and, a second position, wherein said lever member operatively engages said micro-switch pivoting actuator; and said solenoid plunger is operatively coupled to said lever member and is structured to move said lever member between said lever member first position and said lever member second position.

6. The shunt trip assembly of claim 1 wherein said shunt trip assembly housing assembly is a substantially sealed housing assembly.

7. The shunt trip assembly of claim 1 wherein said shunt trip assembly housing assembly includes a single mounting panel.

8. The shunt trip assembly of claim 5, wherein said solenoid is structured to be actuated by said operating current regardless of whether said operating current is AC or DC.

9. The shunt trip assembly of claim 8, wherein said shunt trip assembly is structured to interrupt transmission of said solenoid operating current to said solenoid within 0.033 seconds of said transmission commencing.

10. The shunt trip assembly of claim 9, wherein said shunt trip assembly operating in continuous supply, cut off the power supply to solenoid through actuation of the micro-switch via shunt lever in associated breaker axle position at de-latch condition.

11. The shunt trip assembly of claim 5, wherein pins of the micro-switch of said shunt trip assembly can be used for indicating actuation of the shunt trip via a LED, alarming or other indicating means.

12. The shunt trip assembly of claim 1, wherein said solenoid is structured to be actuated by said operating current regardless of whether said operating current is AC or DC.

13. The shunt trip assembly of claim 12, wherein said shunt trip assembly is structured to interrupt transmission of said solenoid operating current to said solenoid within 0.033 seconds of said transmission commencing.

14. The shunt trip assembly of claim 13, wherein said shunt trip assembly operating in continuous supply, cut off the power supply to solenoid through actuation of the micro-switch via shunt lever in associated breaker axle position at de-latch condition.

15. The shunt trip assembly of claim 1, wherein pins of the micro-switch of said shunt trip assembly can be used for indicating actuation of the shunt trip via a LED, alarming or other indicating means.

* * * * *